US006224700B1

(12) United States Patent
Oakley

(10) Patent No.: US 6,224,700 B1
(45) Date of Patent: May 1, 2001

(54) METHODS FOR WATERPROOFING ARCHITECTURAL SURFACES

(75) Inventor: Brett Oakley, Middletown, OH (US)

(73) Assignee: Mar-Flex Systems, Inc., Middletown, OH (US)

( * ) Notice: Subject to any disclaimer, the term of this patent is extended or adjusted under 35 U.S.C. 154(b) by 0 days.

(21) Appl. No.: 09/189,662

(22) Filed: Nov. 11, 1998

(51) Int. Cl.[7] ..... E04D 11/02

(52) U.S. Cl. ..... 156/71; 52/169.5; 52/169.14; 52/515

(58) Field of Search ..... 52/169.14, 515, 52/169.5, 232, 293.2; 156/71

(56) References Cited

U.S. PATENT DOCUMENTS

| | | |
|---|---|---|
| 2,003,618 | 6/1935 | White . |
| 2,145,284 | 1/1939 | Anderson et al. . |
| 2,721,819 | 10/1955 | Munro . |
| 3,399,091 | 8/1968 | Cornay et al. . |
| 3,577,398 | 5/1971 | Pace et al. . |
| 4,049,853 | 9/1977 | Tortolo . |
| 4,160,058 | 7/1979 | K-Gall . |
| 4,239,795 | 12/1980 | Haage et al. . |
| 4,316,833 | 2/1982 | McGroarty . |
| 4,471,094 | 9/1984 | Uffner et al. . |
| 4,478,912 | 10/1984 | Uffner et al. . |
| 4,537,921 | 8/1985 | Uffner et al. . |
| 4,552,794 | 11/1985 | Goss . |
| 4,693,923 | 9/1987 | McGroarty et al. . |
| 4,775,567 | 10/1988 | Harkness . |
| 4,882,384 | 11/1989 | Willis et al. . |
| 4,939,036 | 7/1990 | Reith . |
| 4,956,207 | 9/1990 | Kauffman et al. . |
| 5,024,886 | 6/1991 | Geisen et al. . |
| 5,352,531 | 10/1994 | Roberts et al. . |
| 5,534,303 | 7/1996 | Roberts et al. . |
| 5,534,583 | 7/1996 | Roberts et al. . |
| 5,576,065 | 11/1996 | Gaveske . |
| 6,025,032 * | 2/2000 | Gaveske ..... 52/169.14 X |

OTHER PUBLICATIONS

"Material Safety Data Sheet" for Rub–R–Wall® Waterproofing (Rubber Polymer Corporation) pp. 1–4, issued Nov. 1, 1992.

Article entitled "Rufco Super Sampson" dated 1994 (Raven Industries).

Brochure entitled "Mar–Koet Drain & Dry" Copyright date 1993 (Mar–Flex Systems, Inc.).

Paper entitled "Wall–Guard" dated 1997 pp. 1–2 (Wallguard Corporation).

* cited by examiner

*Primary Examiner*—Adrienne C. Johnstone
(74) *Attorney, Agent, or Firm*—Biebel & French

(57) ABSTRACT

A method for waterproofing an architectural component comprises the steps of applying a waterproofing composition to the component above a grade line to form an non-swelling elastomeric membrane having a tacky exterior and pressing a flexible, non-porous polymeric sheet onto the tacky exterior of the elastomeric membrane. The polymeric sheet is preferably stronger than the elastomeric membrane so as to protect the elastomeric membrane from punctures or tears. Exemplary waterproofing compositions include solutions of thermoplastic elastomers such as styrene/butadiene block copolymer in volatile organic solvents. Exemplary polymeric sheets include two-ply cross laminated high density polyethylene sheets. Preferably, an upper edge of the polymeric sheet is secured to the architectural surface by means of mastic or fiberglass-backed adhesive tape. According to one embodiment, weep holes are provided in a brick wall laid in front of the architectural surface to provide drainage from the space between the brick wall and the architectural surface.

11 Claims, 5 Drawing Sheets

METHODS FOR WATERPROOFING ARCHITECTURAL SURFACES

FIELD OF THE INVENTION

The present invention pertains to methods for waterproofing architectural components in situ by applying waterproofing compositions to form elastomeric membranes over the components and adhering polymeric sheets to surfaces of those membranes to protect the surfaces from punctures and tears.

BACKGROUND OF THE INVENTION

Typically, architectural components such as walls are designed, at least in part, to isolate the interiors of buildings from the environment. For example, the walls of a building are typically constructed so as to exclude excessive levels of water and water vapor from the interior of the building. Apart from possible discomfort of occupants of the building, excessive levels of water or water vapor may lead to impairment of materials used to construct the building. For this reason, those skilled in the art have adopted various techniques for waterproofing architectural components.

Prefabricated "peel and stick" waterproofing materials have been proposed, such as those shown in Uffner U.S. Pat. Nos. 4,478,912 and 4,537,921, and in Harkness U.S. Pat. No. 4,775,567. These materials have have included contact adhesives for adhering the materials to the exteriors of architectural components they were intended to waterproof. While these "peel and stick" materials were easy to apply under ideal circumstances, they did not conform well to irregular surfaces. Apart from this, the adhesives used to secure these materials to the architectural components often did not bond tightly or durably with the exteriors of the components.

One prior art technique for waterproofing architectural components included spreading asphaltic or bituminous materials over the components and allowing the materials to harden to form water-resistant layers. One drawback to this technique was that the water-resistant layers formed in this manner were prone to cracking as the underlying architectural components themselves expanded, contracted or cracked. Such cracking of the water-resistant layers provided water-conducting channels through the layers, thereby compromising the value of the layers as waterproofing. Attempts to prevent such cracking by adhering textile materials or felt to the exteriors of the layers were not uniformly successful.

Roberts et al. U.S. Pat. No. 5,352,531 proposed a solvent mixture of a petroleum distillate and toluene used to dissolve a hydrocarbon resin and block copolymers of styrene and butadiene. The solution was applied to newly constructed basement walls to provide a water-resistant elastomeric coating on the walls.

Raskin et al. U.S. Pat. No. 2,752,275 proposed a masonry construction unit having on one surface an initial coating comprising a polyester resin and a filler; a fibrous mat bonded to the initial coating; and a finish coating on the outer surface of the fibrous mat. After eliminating any moisture in the masonry construction unit, the initial coating was applied by means, for example, of a blade or trowel. While the initial coating was in a more or less tacky state, a layer of fibrous mat material was applied thereover. Upon the surface of this mat there was then applied the finish coating. Surfaces formed in this manner have been criticized as being fragile, subject to cracking similar to that which bedeviled water-resistant layers formed from asphaltic or bitumenous materials.

K-Gall U.S. Pat. No. 4,160,058 proposed a waterproof covering device including a textile core. The textile core was covered on its external side with an external waterproof pellicle or film and was united with a base through an internal film. To manufacture the covering device, a fluid material which would produce the internal film was brought on the surface of the base. While a part of this fluid material was still in its fluid state, the textile core was laid down on it. The external pellicle apparently was formed on the textile core either before or after the textile core was laid down on the internal film. An important characteristic of this covering device lay on the fact that there remained, between the external pellicle and the internal film, a portion of non-impregnated textile which retained its flexibility.

Despite these proposals, there remains a need in the art for methods for waterproofing architectural surface in which durable waterproofing coverings are formed in situ in a relatively fast and efficient manner.

SUMMARY OF THE INVENTION

This need and others are addressed by a method for waterproofing an architectural component comprising the steps of applying a waterproofing composition to an exterior of the component above a grade line to form a non-swellable elastomeric membrane having a tacky surface and pressing a flexible, non-porous polymeric sheet formed of a material stronger than the elastomeric membrane onto the tacky surface of the elastomeric membrane. Since the membrane which couples the flexible, non-porous polymeric sheet to the exterior of the architectural component is elastomeric, it can stretch to accomodate expansion, contraction or cracking of the underlying architectural component without cracking itself. On the other hand, the inherent weakness of the elastomeric material leaves its surface vulnerable to punctures and tears. The polymeric sheet which adheres to the surface of the elastomeric membrane acts as a tough skin to protect the surface of the elastomeric membrane from damage.

Exemplary waterproofing compositions include solutions of non-swellable thermoplastic elastomers such as styrene/butadiene block copolymers dissolved in volatile organic solvents. Preferably, such compositions are airlessly sprayed or painted onto the architectural components by techniques familiar to those of ordinary skill in the art to form viscous films on the components' exteriors. As the volatile organic solvents evaporate, the thermplastic elastomers harden to form the elastomeric membranes.

Exemplary polymeric sheets include two-ply cross-laminated high density polyethylene sheets. Preferably, upper edges of the polymeric sheets are secured to the exteriors of the architectural components by means of waterproof securing aids such as mastic or fiber glass-backed adhesive tape to prevent moisture from seeping downwardly past the polymeric sheets and the elastomeric membranes. The polymeric sheets may also be secured around windows or other openings in a similar fashion to prevent water from seeping through the waterproofing system.

In accordance with an especially preferred embodiment, bricks are laid adjacent the polymeric sheets to form exterior walls or other features of buildings. Weep or drainage holes are formed in the lowest courses of the bricks, either in the bricks themselves or in the surrounding mortar. Water which condenses and collects on the surfaces of the polymeric sheets runs downwardly between the sheets and the bricks so as to drain through the weep holes to the exteriors of the buildings.

The invention will be further described in conjunction with the appended drawings and detailed description.

DETAILED DESCRIPTION OF THE PREFERRED EMBODIMENT(S)

Figure 1:
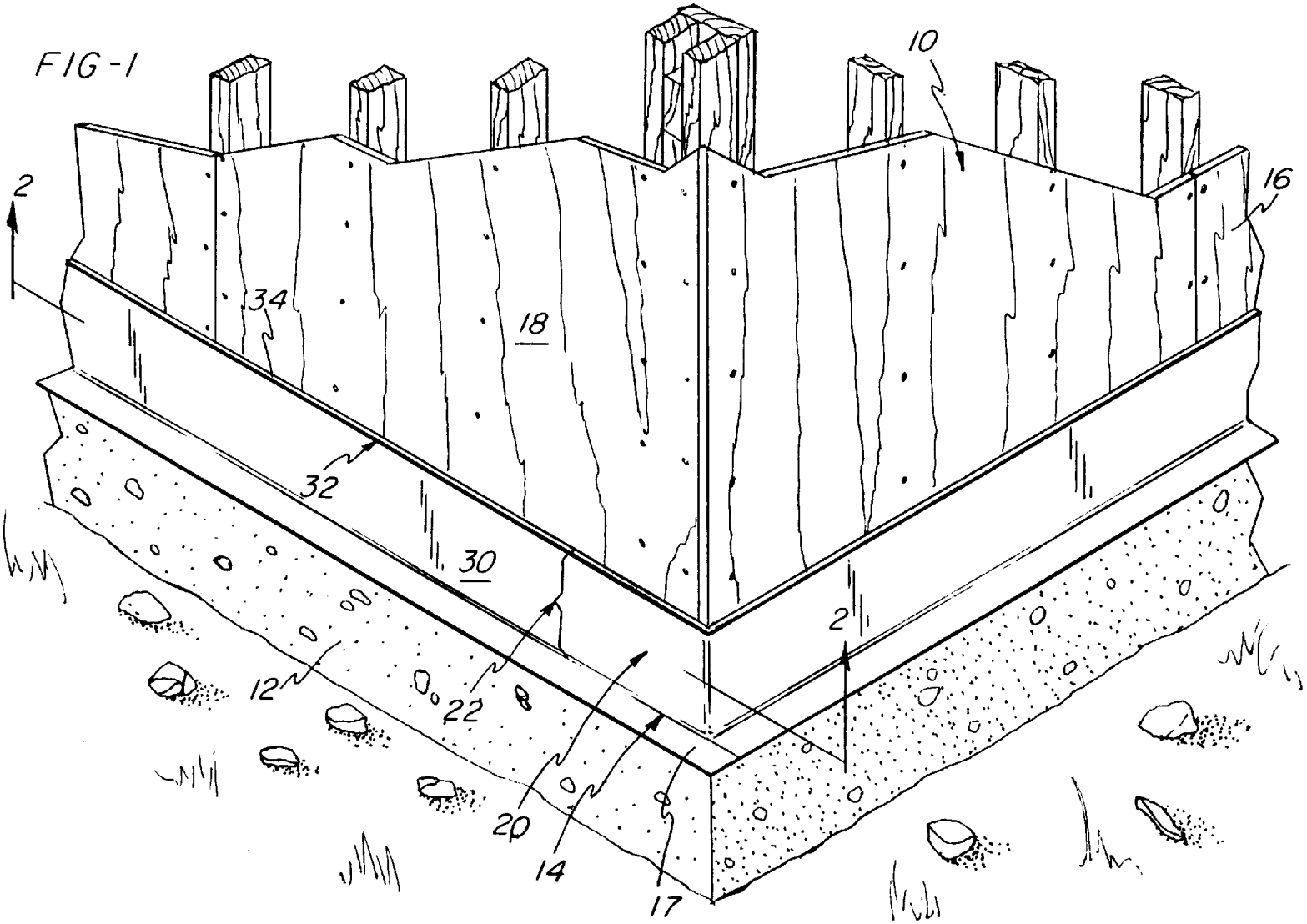
FIG. 1 is a side elevational view of an architectural component waterproofed by the method of the invention.

FIG. 1 shows an architectural component, namely a wall structure 10 seated on a concrete foundation element 12 which extends parallel to a grade line 14. A plywood sheathing 16 defines an exterior 18 of the wall structure 10. A waterproofing system 20 covers an area 22 of the exterior 18 of the wall structure 10 near the concrete foundation element 12 and overlying brick ledge 17 to impede the passage of moisture through the wall structure 10.

Figure 2:
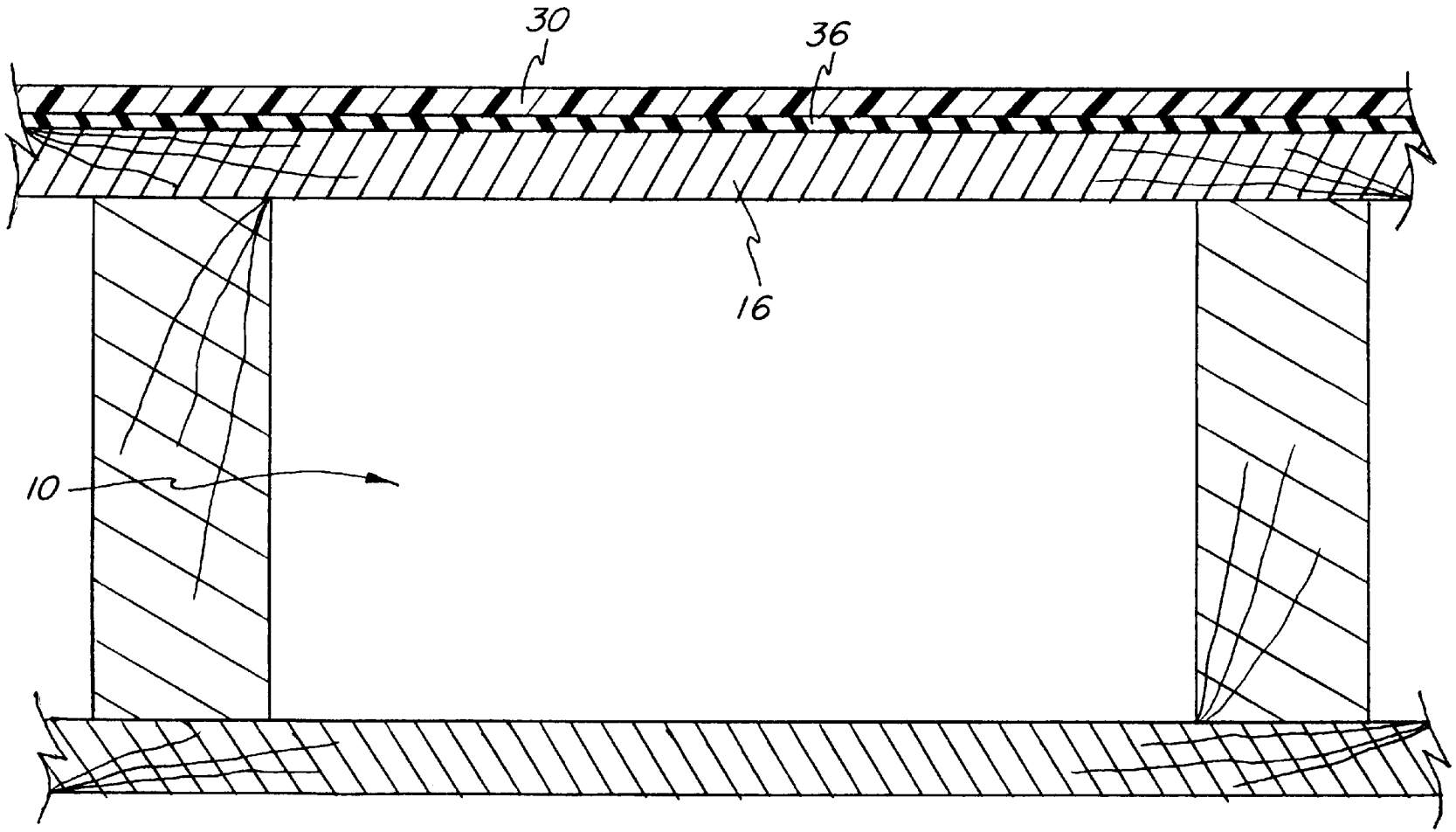
FIG. 2 is a sectional view taken along the line 2—2 in FIG. 1.

The waterproofing system 20 includes a polymeric sheet or outer layer 30 having an upper edge 32 secured to the exterior 18 of the wall structure 10 using a securing aid 34. As best shown in FIG. 2, the waterproofing system 20 also includes an elastomeric membrane or base layer 36 which adhesively couples the polymeric sheet 30 to the wall structure 10.

A preferred method for forming the waterproofing system 20 includes the steps of applying a waterproofing composition to the architectural surface 16 to form the elastomeric membrane 36 and adhering the polymeric sheet 30 to the elastomeric membrane 36.

Figure 3:
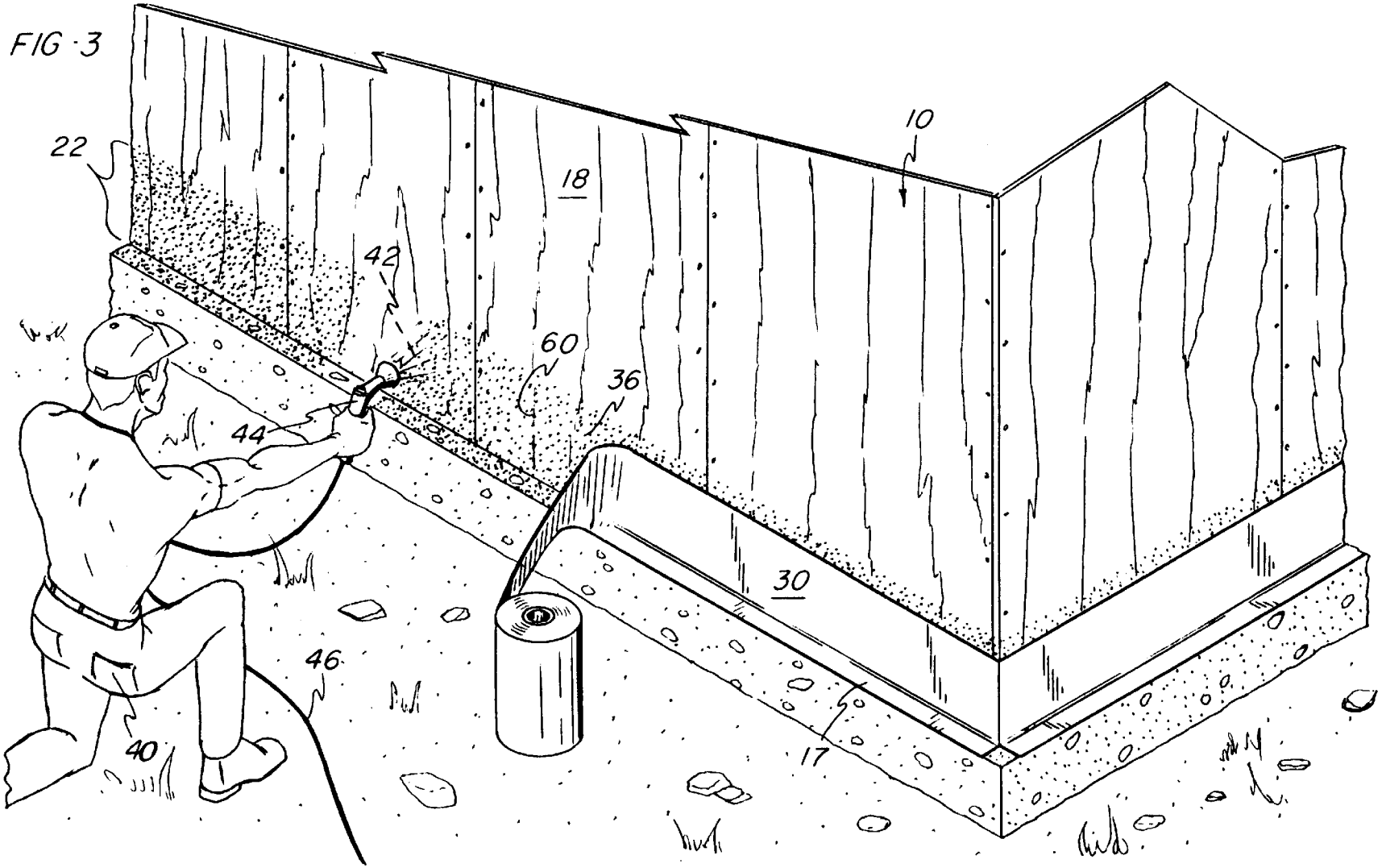
FIG. 3 is a schematic view of a worker applying a waterproofing composition to an architectural component to form an elastomeric membrane and then pressing a polymeric sheet against the elastomeric membrane in accordance with a preferred embodiment of the invention.

FIG. 3 shows a worker 40 airlessly spraying a waterproofing composition 42 onto the area 22 of the exterior 18 of the wall structure 10 along brick ledge 17 in a manner well known to those of ordinary skill in the art. More specifically, the waterproofing composition 42 is stored in a pressurized tank (not shown) which is in fluid communication with a spray nozzle 44 through a flexible hose 46. The spray nozzle 44 breaks up the flow of the waterproofing composition 42 into streams or droplets which are then projected from the spray nozzle 48.

The worker 40 directs the spray nozzle 44 toward the area 22 to which the waterproofing composition 42 is to be applied. The worker 40 then manipulates a valve (not shown) in the spray nozzle 44 to selectively enable the waterproofing composition 42 to flow from the pressurized tank (not shown) through the hose 46 and the spray nozzle 44 onto the exterior 18 of the wall structure 10. By moving the spray nozzle 44 relative to the exterior 18 of the wall structure 10, the worker 40 can produce an evenly distributed film of the waterproofing composition 42 throughout the area 22. This film subsequently hardens (though it remains tacky) to form the elastomeric membrane 36.

The use of an airless spraying technique is preferred in that it is capable of producing a film of the waterproof composition 42 devoid of air bubbles which might result either in porosity or a loss of the ability of the elastomeric membrane 36 to stretch so as to avoid cracking. Nonetheless, it is within the contemplation of the invention to use other means, such as painting, to apply the waterproofing composition 42 to the exterior 18 of the wall structure 10.

Exemplary waterproofing compositions include solutions of non-swelling thermoplastic elastomers such as styrene/butadiene block copolymers in volatile organic solvents. An especially preferred waterproofing composition, sold by Mar-Flex Systems, Inc. of Middletown, Ohio under the trademark SUNFLEX, hardens to form an elastomeric material which is insoluble in water (ASTM-D-2939-¶17) and has a water vapor transmission rate of 0.13 grains/ft$^2$-hr [~91 mg/m$^2$-hr] (ASTM-E-98-88). Notably, the elastomeric material so formed is capable of approximately 1800% elongation (ASTM-D-412) so as to resist cracking due to dimensional changes or cracking of the underlying architectural component.

The especially preferred waterproofing composition comprises the following:

| SOLIDS: | |
|---|---|
| Component | Weight Percent |
| SOLPRENE 411 | 5.3 |
| SOLPRENE 1205 | 9.6 |
| Pigment | 1.6 |
| Total Solids | 16.5 |
| **SOLVENTS:** | |
| Component | Weight Percent |
| SHELLFLEX 3371 | 28.1 |
| Hexane | 11.9 |
| Heptane | 32.6 |
| Toluene | 10.9 |
| Total Solvents | 83.5 |

Note that the weight percents are based on the total weight of solids and solvents in the waterproofing composition.

The SOLPRENE 411 and 1205 components are styrene/butadiene block copolymers available from Housemex, Inc. of Akron, Ohio. The SOLPRENE 411 polymer is approximately 30% styrene whereas the SOLPRENE 1205 polymer is approximately 25% styrene.

The SHELLFLEX 3371 component is a liquid and is described as a hydrotreated heavy napthenic distillate. The Chemical Abstracts Registry indicates that it is a complex combination of hydrocarbons obtained by treating a petroleum fraction with hydrogen in the presence of a catalyst. It consists of hydrocarbons having carbon numbers predominantly in the range of C-20 through C-50. The product is a finished oil of at least 100 SUS viscosity at 100° F. It contains relatively few normal paraffins.

The SHELLFLEX 3371 product is available from Shell Oil Company and is further described as a processing oil for use in combination with synthetic and natural elastomers. Without wishing to be bound by any theory of operation, it is believed that this "processing oil" serves as a plasticizer, helping to "wet" the elastomeric copolymer. In so doing, the SHELLFLEX 3371 product improves the ability of the hardened elastomeric material to stretch and also promotes the tackiness at the surfaces (only one shown at 60) of the preferred elastomeric membrane 36.

While an especially preferred waterproofing composition has been described in detail, those skilled in the art will recognize that other waterproofing compositions also will fulfill the requirements of the invention. The properties and advantages described are those of the especially preferred material and need not be met by an equivalent composition.

FIG. 3 also shows the polymeric sheet 30 being applied to the elastomeric membrane 36 by pressing the polymeric sheet 30 against the external surface 60 of the elastomeric membrane 36. Preferably, the elastomeric membrane 36 remains tacky near the surface 60 for a sufficient period of time after the waterproofing composition 42 is applied to the exterior 18 of the wall structure 10 so that the polymeric sheet 30 will adhere to the elastomeric membrane 36 without the use of a separate adhesive. While it appears that elastomers formed by the hardening of the especially preferred SUNFLEX waterproofing composition remain tacky indefinitely, those skilled in the art will understand that the elastomeric membrane 36 need remain tacky only long enough to permit the worker 40 to adhere the polymeric sheet 30 to the elastomeric membrane 36.

Exemplary polymeric sheet materials include flexible, non-porous two-ply cross laminated high density polyethylene sheet materials. An especially preferred two-ply cross laminated high density polyethylene sheet material is available from Raven Industries, Inc. of Sioux Falls, S. Dak. under the designation Rufco. This especially preferred material has a tensile strength rating of approximately 7250 psi [~$5.0\times10^7$ N/m$^2$] (ASTM-D-882) and a puncture force rating of approximately 15.3 lbs. [~68 N] (FTMS 101C), each of which are believed to represent greater strength than that possessed by the preferred styrene/butadiene block copolymers. As such, the preferred sheet material is well adapted to protect the surface 60 of the elastomeric membrane 36 from punctures and tears.

While an exemplary polymeric sheet material has been described in detail, those skilled in the art will recognize that other polymeric sheet materials also will fulfill the requirements of the invention. The properties and advantages described are those of the especially preferred material and need not be met by an equivalent composition.

Figure 4:
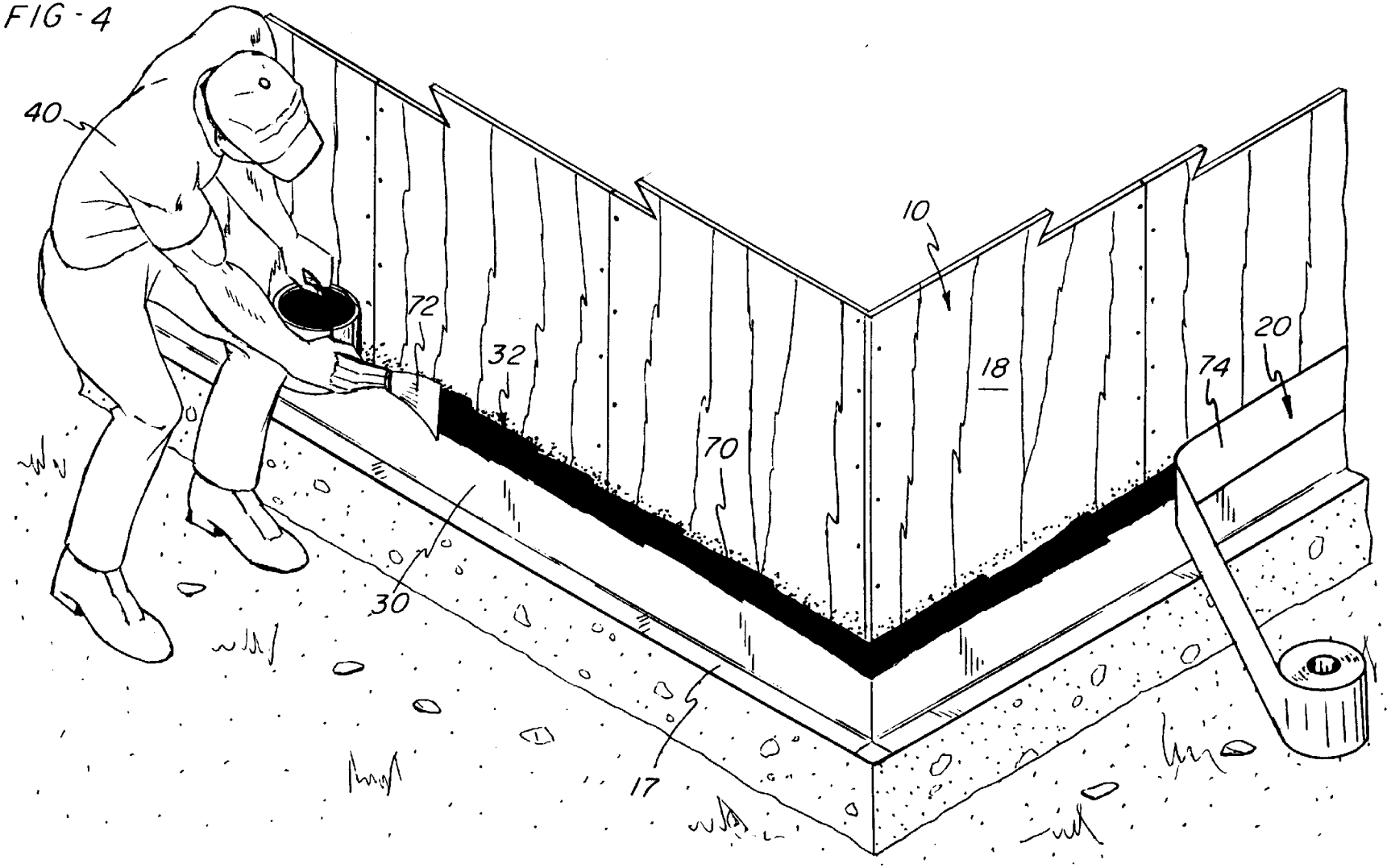
FIG. 4 is a schematic view of a worker securing an upper edge of the polymeric sheet to the architectural component in accordance with this preferred embodiment of the invention.

FIG. 4 shows the worker 40 securing the upper edge 32 of the polymeric sheet 30 to the exterior 18 of the wall structure 10. Securing the upper edge 32 of the polymeric sheet 30 to the exterior 18 of the wall structure 10 serves to prevent water from seeping down past the waterproofing system 20 to the wall structure 10.

In FIG. 4, the worker 40 is spreading mastic 70 along the upper edge 32 using a trowel 72 to secure the upper edge 32 to the wall structure 18. Preferably, the mastic 70, once applied, is covered by a waterproof adhesive tape 74 such as a fiber glass-backed adhesive tape to further secure the upper edge 32 of the polymeric sheet 30 to the wall structure 10. Alternatively, the upper edge 32 may be secured to the wall structure 10 solely with waterproof adhesive tape.

Figure 5:
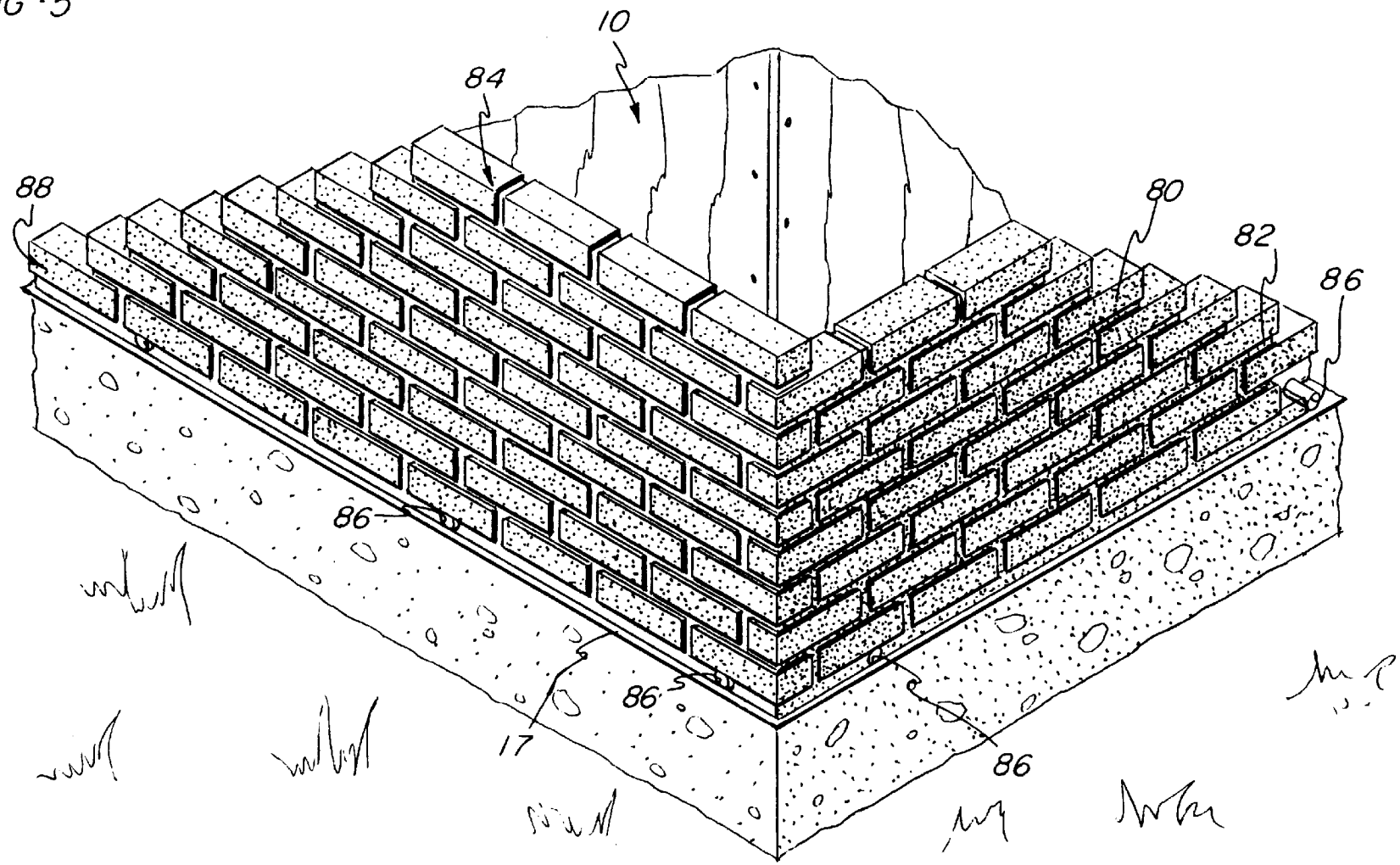
FIG. 5 is a schematic view of a brick wall partially laid adjacent the architectural component in accordance with this preferred embodiment of the invention.

FIG. 5 shows bricks 80 laid adjacent to the polymeric sheet 30 (FIGS. 2–4). The bricks 80 are coupled together with mortar 82 to form an outer wall 84 on top of the brick ledge 17. Weep holes or drainage holes 86 are formed in the mortar along the lowest course 88 of the bricks 80 to provide drainage for water trapped between the waterproofing system 20 and the outer wall 84. This allows water which condenses or collects on the polymeric sheet 30 (FIGS. 2–4) to run downwardly and drain through the weep holes 86 back into the outside environment.

While the preferred method has been described in connection with the waterproofing of an area 22 (FIG. 1) of the exterior 18 (FIG. 1) of the wall structure 10 (FIG. 1) in the neighborhood of the grade line 14 (FIG. 1), those skilled in the art will recognize that the method is not so limited. Rather, the method may be applied to the entire surface area of an architectural component or to any part thereof, anywhere above the grade line 14 (FIG. 1). Where the method is applied to architectural components having windows or other openings, the polymeric sheet 30 (FIGS. 2–4) is preferably provided with a corresponding aperture (not shown) and secured around the window or opening using a securing aid such as mastic or waterproof adhesive tape, or both. In addition to the disclosed use along brick ledges the waterproofing components and methods can be used, for example, to seal windows, band boards, and doors. All flashing applications will benefit from the invention.

The methods of the present invention provide durable waterproofing systems 20 (FIG. 1) which are quickly and easily formed in situ as described previously. Such system 20 (FIG. 1) provides durable water resistance in that the elastomeric membrane is capable of stretching to accomodate expansion, contraction or cracking of the underlying architectural component 10 (FIG. 1) without cracking itself. The polymeric sheet 30 (FIGS. 2–4) promotes the durability of the waterproofing system 20 (FIG. 1) by protecting the surface 60 (FIG. 3) of the elastomeric membrane 36 (FIG. 3) from punctures or tears which might compromise the water-resistance of the membrane 36 (FIG. 3) or the ability of the membrane 36 (FIG. 3) to stretch without breaking.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method for waterproofing an architectural component above a grade line comprising the steps of:

a) applying to an exterior surface of said architectural component above said grade line a waterproofing composition, said waterproofing composition hardening to form a non-swelling elastomeric membrane over said exterior surface, said elastomeric membrane having a tacky exterior; and b) pressing a flexible, non-porous polymeric sheet onto said tacky exterior, said polymeric sheet having greater strength than said elastomeric membrane.

2. The method as recited in claim 1 wherein said step a) includes spraying said waterproofing composition onto said architectural component.

3. The method as recited in claim 1 wherein said step a) includes airlessly spraying said waterproofing composition onto said architectural component.

4. The method as recited in claim 1 wherein said step a) includes painting said waterproofing composition onto said architectural component.

5. The method as recited in claim 1 wherein said waterproofing composition of said step a) is a non-swelling thermoplastic elastomer dissolved in a volatile organic solvent.

6. The method as recited in claim 1 wherein said waterproofing composition of said step a) is a styrene/butadiene block copolymer dissolved in a volatile organic solvent.

7. The method as recited in claim 1 wherein said polymeric sheet of said step b) is a two-ply, cross-laminated high density polyethylene sheet.

8. The method as recited in claim 1 including the additional step of:

c) securing an upper edge of said polymeric sheet to said architectural component.

9. The method as recited in claim 1 including the additional step of:

c) securing an upper edge of said polymeric sheet to said architectural component with a securing aid selected from the group consisting of mastic and waterproof adhesive tape.

10. The method as recited in claim 1 including the additional steps of:

c) laying bricks adjacent said polymeric sheet; and d) forming weep holes along a lowest course of said bricks.

11. A method for waterproofing an architectural component above a grade line comprising the steps of:

a) spraying a waterproofing composition of a non-swelling thermoplastic elastomer dissolved in a volatile organic solvent onto an exterior surface of said architectural component above said grade line to form an elastomeric membrane having a tacky exterior;

b) pressing a flexible, non-porous polymeric sheet onto said tacky exterior, said polymeric sheet having a strength greater than said elastomeric membrane;

c) securing an upper edge of said polymeric sheet to said architectural component;

d) laying bricks adjacent said polymeric sheet; and e) forming weep holes along a lowest course of said bricks.

* * * * *